US006478686B1

(12) United States Patent
Chen

(10) Patent No.: US 6,478,686 B1
(45) Date of Patent: Nov. 12, 2002

(54) BOWLING PIN HAVING REINFORCING STRUCTURE

(75) Inventor: Chin Tsai Chen, Taichung Hsien (TW)

(73) Assignee: Jeng Fen Shuttle & Bottin Co., Ltd., Taichung Hsien (TW)

( * ) Notice: Subject to any disclaimer, the term of this patent is extended or adjusted under 35 U.S.C. 154(b) by 0 days.

(21) Appl. No.: 09/930,407

(22) Filed: Aug. 16, 2001

(51) Int. Cl.[7] ..... A63D 9/00
(52) U.S. Cl. ..... 473/119; 473/120; 473/123
(58) Field of Search ..... 482/109; 473/119, 473/120, 121, 122, 123

(56) References Cited

U.S. PATENT DOCUMENTS 1,053,654 A * 2/1913 Seidel
1,053,957 A * 2/1913 Seidel
1,214,126 A * 1/1917 Boldt
2,223,574 A * 12/1940 Paves
3,300,214 A * 1/1967 Nichols
4,848,745 A * 7/1989 Bohannan et al.

* cited by examiner

*Primary Examiner*—William M. Pierce
(74) *Attorney, Agent, or Firm*—Charles E. Baxley

(57) ABSTRACT

A bowling pin includes a bar secured on top of a core for forming a neck portion of the bowling pin, and a reinforcing rod engaged in the core and the bare for reinforcing the core and the bar. The bar may include a projection engaged into the core for solidly securing the bar to the core. The reinforcing rod may include an outer thread for threading to the core. One or more outer panels may be engaged around the core and around a portion of the bar for solidly securing the bar to the core. An outer cloth layer may be engaged around the outer panels for reinforcing the outer panels.

4 Claims, 4 Drawing Sheets

BOWLING PIN HAVING REINFORCING STRUCTURE

BACKGROUND OF THE INVENTION

1. Field of the Invention

The present invention relates to a bowling pin, and more particularly to a bowling pin including a reinforcing structure.

2. Description of the Prior Art

Typical bowling pins are required to be stricken by the bowling balls, and are thus required to be made of stronger wood materials, such as the wood materials of the maple trees. As shown in FIG. 4, illustrated is a typical bowling pin made of such as the maple wood material. The bowling pin is directly machined or manufactured from a maple wood log material, by such as the lathing machines. However, a large portion of the maple wood material should be cut off before the bowling pin may be formed or produced. In addition, the neck portion of the bowling pin will become the weakest portion that may be easily broken. Furthermore, it has become more and more difficult to obtain the maple wood materials.

The present invention has arisen to mitigate and/or obviate the afore-described disadvantages of the conventional bowling pins.

SUMMARY OF THE INVENTION

The primary objective of the present invention is to provide a bowling pin including a reinforcing structure for increasing the striking resistive effect to the bowling pin and for increasing the working life to the bowling pin.

The other objective of the present invention is to provide a bowling pin made of less wood material and made of less maple wood material.

In accordance with one aspect of the invention, there is provided a bowling pin comprising a core, a bar secured on top of the core for forming a neck portion of the bowling pin, and a reinforcing rod engaged in the core and the bare for reinforcing the core and the bar.

The core includes a recess formed therein, the bar includes a projection extended therefrom and engaged into the recess of the core for solidly securing the bar to the core.

The core includes a screw hole formed therein, the reinforcing rod includes an outer thread for threading to the screw hole of the core and for solidly securing the reinforcing rod and the bar to the core.

One or more outer panels may further be provided and engaged around the core, and preferably engaged around a portion of the bar for solidly securing the bar to the core.

An outer cloth layer or such as the woven or non-woven cloth material may further be provided and engaged around the outer panels for reinforcing the outer panels.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
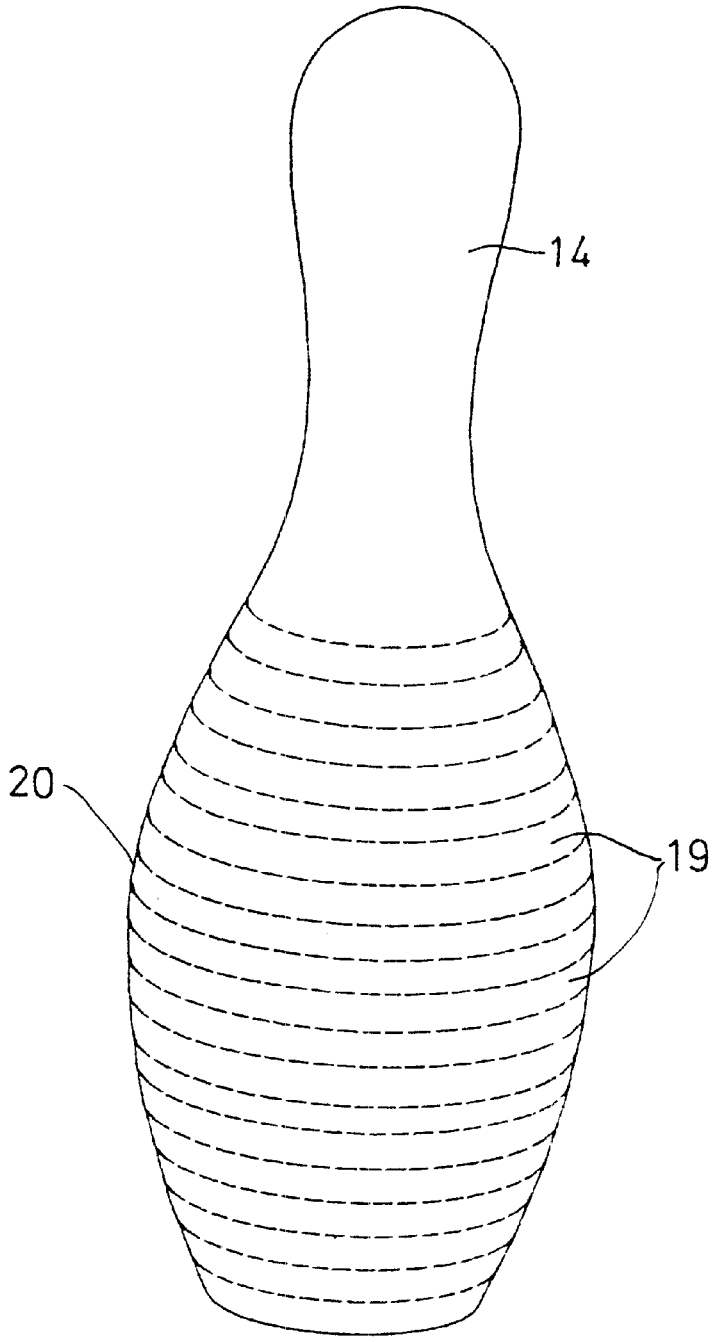
FIG. 1 is a perspective view of a bowling pin in accordance with the present invention.
Figure 2:
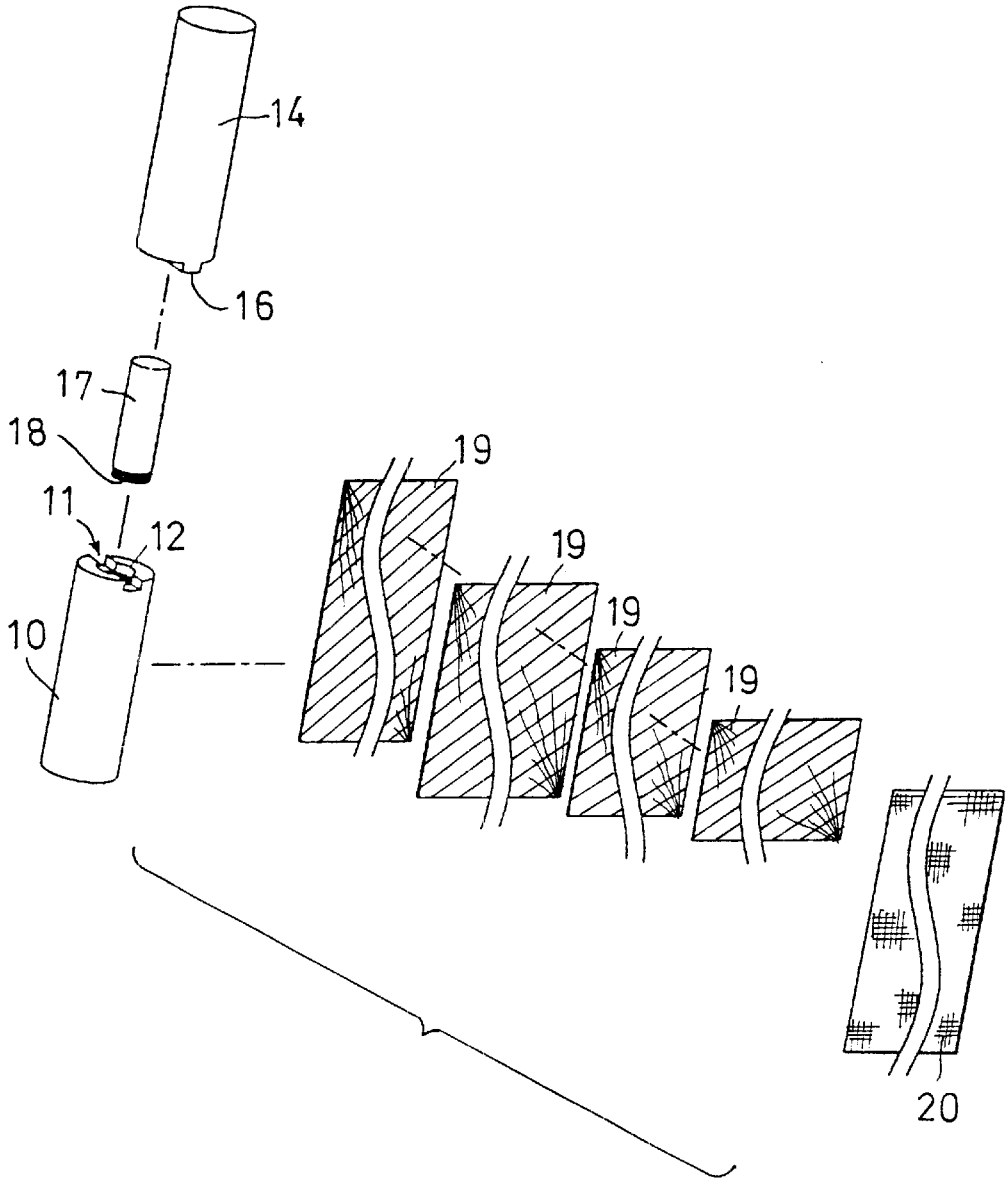
FIG. 2 is an exploded view of the bowling pin.

Referring to the drawings, and initially to FIGS. 1 and 2, a bowling pin in accordance with the present invention comprises a core 10 including a recess 11 formed in the upper portion thereof, and including a hole, such as a screw hole 12 formed in the upper portion thereof and communicating with the recess 11 thereof. It is preferable that the recess 11 is formed across the upper portion of the core 10 and has two open ends. A bar 14 includes a projection 16 extended downward therefrom and engaged into the recess 11 of the core 10. The projection 16 of the bar 14 may be secured to the core 10 with such as a force-fitted engagement, an adhesive material, or by fasteners, or the like, for solidly securing the bar 14 to the core 10 and for preventing the bar 14 from being easily broken relative to the core 10.

A reinforcing rod 17 has one end, such as the upper end engaged in the bar 14, and has the other end, such as the lower end engaged in the core 10. The rod 17 may include an outer thread 18 formed in the lower portion thereof for threading with the inner thread or the screw hole 12 of the core 10, and for further solidly securing the bar 14 to the core 10. The rod 17 may be made of stronger wood materials, metal materials, fiber reinforcing materials, or the like, for increasing the bending strength of the neck portion of the bowling pin. The bar 14 will be machined into the neck portion of the bowling pin and is preferably made of maple wood material has has a better anti-striking effect. The core 10 may be made of the other materials, or wood materials, or made of the waste wood materials, for environment protection purposes.

Figure 3:
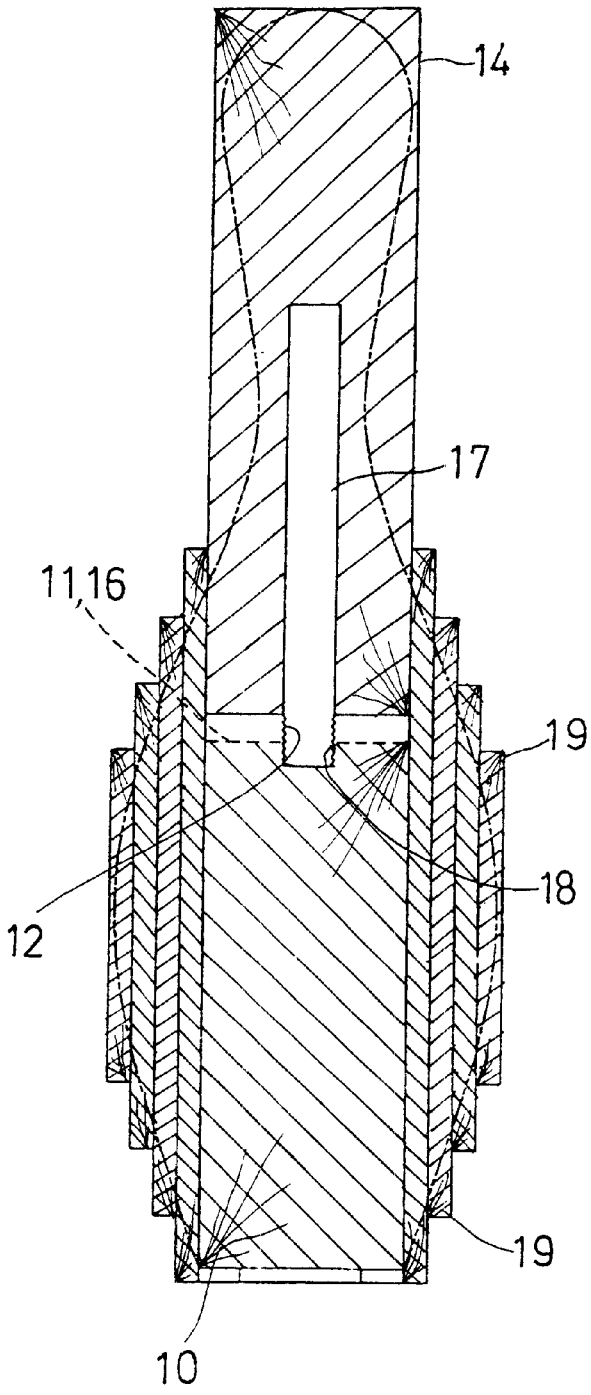
FIG. 3 is a cross sectional view illustrating the formation or the manufacturing of the bowling pin.
Figure 4:
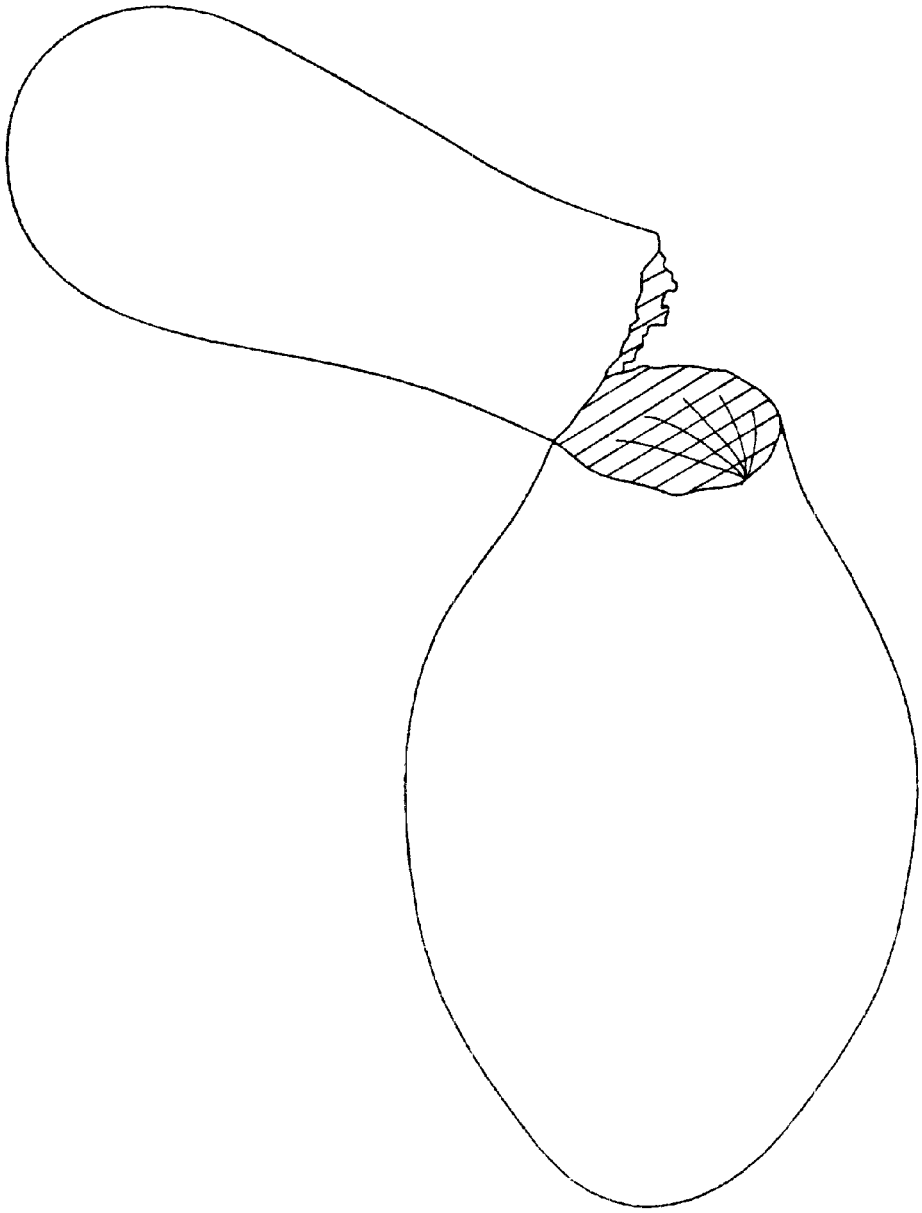
FIG. 4 PRIOR ART
FIG. 4 is a perspective view showing the typical bowling pin.

A number of outer panels 19 are further provided and engaged onto the outer peripheral portion of the core 10, and preferably engaged onto a portion of the outer peripheral portion of the bar 14, best shown in FIG. 3. The outer panels 19 are preferably made of thin layer wood material, and include different height, for allowing the outer panels 19 to be engaged onto or secured onto the outer peripheral portion of the core 10 and the bar 14, by such as the adhesive materials, in a shape close to an elliptical shape. The outer panels 19 will then be machined into the elliptical lower portion of the bowling pin. The outer panels 19 may also be made of the other materials, or wood materials, or made of the waste wood materials, for environment protection purposes.

A woven or non-woven outer cover layer 20 may further be provided and engaged around the lower portion of the bowling pin or around the outer panels 19. The outer panels 19 may be made of wood materials and may thus include a weak anti-striking strength. primarily due to the wood veins of the wood materials. The outer cover layer 20 of woven or non-woven cloth materials may be secured onto the outer peripheral portion of the outer panels 19 with resins or with the other adhesive materials, for forming a smooth outer peripheral surface and for reinforcing the outer panels 19.

It is to be noted that the core 10 and the reinforcing rod 17 and the outer panels 19 are not required to be made of maple wood material and may be made of the other wood materials or the other materials, such as the plastic materials, the composite materials, or the like. The bar 14 is preferably made of maple materials, but may also be made of the other wood materials or the other materials, such as the plastic materials, the composite materials, or the like. The rod 17 may reinforcing the bar 14 or the neck portion of the bowling pin, for preventing the neck portion of the bowling pin from being easily broken. The engagement of the outer cover layer 20 onto the outer panels 19 may further reinforcing the outer panels 19 and may increasing the anti-striking strength to the bowling pin.

It is further to be noted that the thin layer outer wood panels 19 may be made or formed to an area or to a shape closer to the final shape of the bowling pin to be formed, such that less wood material will be cut off, and such that less wood material is required for forming the bowling pins.

Accordingly, the bowling pin in accordance with the present invention includes a reinforcing structure for increasing the striking resistive effect to the bowling pin and for increasing the working life to the bowling pin.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bowling pin comprising:

a core, a bar secured on top of said core for forming a neck portion of said bowling pin, a reinforcing rod engaged in said core and said bar for reinforcing said core and said bar, and at least one outer panel engaged around said core.

2. The bowling pin according to claim 1, wherein said core includes a recess formed therein, said bar includes a projection extended therefrom and engaged into said recess of said core for solidly securing said bar to said core.

3. The bowling pin according to claim 1, wherein said core includes a screw hole formed therein, said reinforcing rod includes an outer thread for threading to said screw hole of said core and for solidly securing said reinforcing rod and said bar to said core.

4. The bowling pin according to claim 1 further comprising an outer cloth layer engaged around said at least one outer panel for reinforcing said at least one outer panel.

* * * * *

UNITED STATES PATENT AND TRADEMARK OFFICE

CERTIFICATE OF CORRECTION

PATENT NO. : 6,478,686 B1
DATED : November 12, 2002
INVENTOR(S) : Chin Tsai Chen It is certified that error appears in the above-identified patent and that said Letters Patent is hereby corrected as shown below:

Title page,
Item [73], Assignee, the correct spelling of the Assignee's name is
-- Jeng Feng Shuttle & Bobbin Co., Ltd. --.

Signed and Sealed this

Thirteenth Day of January, 2004

JON W. DUDAS
*Acting Director of the United States Patent and Trademark Office*